United States Patent [19]

Weidig

[11] 4,440,545

[45] Apr. 3, 1984

[54] GASOHOL HAVING CORROSION INHIBITING PROPERTIES

[75] Inventor: Charles F. Weidig, Grosse Pointe, Mich.

[73] Assignee: Ethyl Corporation, Richmond, Va.

[21] Appl. No.: 317,574

[22] Filed: Nov. 2, 1981

[51] Int. Cl.[3] ..... C10L 1/18

[52] U.S. Cl. ..... 44/56; 44/70; 252/396

[58] Field of Search ..... 44/56, 70; 252/396

[56] References Cited

U.S. PATENT DOCUMENTS

| | | | |
|---|---|---|---|
| 2,334,158 | 11/1943 | Fuchs et al. | 252/56 |
| 2,349,044 | 5/1944 | Jahn | 252/396 |
| 2,962,443 | 11/1960 | Rhodes | 252/56 |
| 2,993,772 | 7/1961 | Stromberg | 52/0.5 |
| 2,993,773 | 7/1961 | Stromberg | 52/0.5 |
| 3,117,091 | 1/1964 | Staker | 252/56 |
| 3,287,268 | 11/1966 | Bayonne | 252/48.4 |
| 3,346,354 | 10/1967 | Kautsky et al. | 44/63 |
| 3,447,918 | 6/1969 | Amick | 44/70 |
| 3,574,574 | 4/1971 | Moore et al. | 44/66 |
| 3,632,510 | 1/1972 | LeSuer | 252/35 |
| 3,687,644 | 8/1972 | Delafield et al. | 44/56 |
| 4,148,605 | 4/1979 | Andress, Jr. | 422/7 |
| 4,175,927 | 11/1979 | Niebylski | 44/68 |
| 4,177,768 | 12/1979 | Davis | 123/1 A |
| 4,185,594 | 1/1980 | Perilstein | 123/1 A |
| 4,207,076 | 6/1980 | Bove | 44/56 |
| 4,207,077 | 6/1980 | Bove et al. | 44/56 |
| 4,214,876 | 7/1980 | Garth et al. | 44/66 |
| 4,227,889 | 10/1980 | Perilstein | 44/56 |
| 4,242,099 | 12/1980 | Malec | 44/53 |
| 4,248,182 | 2/1981 | Malec | 123/1 A |
| 4,294,585 | 10/1981 | Sung | 44/56 |

*Primary Examiner*—Charles F. Warren
*Assistant Examiner*—Y. Harris-Smith
*Attorney, Agent, or Firm*—Donald L. Johnson; John F. Sieberth; Joseph D. Odenweller

[57] ABSTRACT

Liquid fuels for use in internal combustion engines comprising (i) a major fraction of hydrocarbons boiling in the gasoline boiling range, (ii) a minor amount of ethanol, and (iii) a corrosion inhibiting amount of a hydrocarbyl succinic acid or anhydride having from about 8 to 30 carbon atoms.

5 Claims, No Drawings

GASOHOL HAVING CORROSION INHIBITING PROPERTIES

BACKGROUND

1. Field of the Invention

This invention relates to novel fuel compositions for use in spark ignited internal combustion engines. More particularly, this invention relates to gasoline-ethanol fuel mixtures having rust inhibiting and/or preventing properties. The invention also is concerned with a process for conferring anti-corrosion properties to ethanol in gasoline fuel mixtures.

2. Description of the Prior Art

Worldwide concern over the growing shortages of crude oil supplies has promoted the use of many materials as blending agents in gasoline to extend the fuel supply. From the engine or motor vehicle manufacturers' point of view, it seems easiest to employ alcohol blended with gasoline. Methanol, ethanol and t-butyl alcohol have emerged as the most widely used alcohol blending agents. Recently, a high level of interest has been shown in the use of "Gasohol," defined herein as a blend of gasoline with from about 5 volume percent to about 30 volume percent ethanol, as an automotive fuel. Interest has been especially high in countries such as Brazil which have an intense cultivation of sugar cane, mandioca and other raw materials of vegetable origin adequate for the production of ethanol.

The use of a polar oxygenate such as ethanol in gasoline blends, however, has far reaching consequences. One of these is the creation of corrosion problems both in the logistic chain and in the vehicle itself. In pipelines and storage tanks rust, which normally would remain on the walls, is loosened by the alcohol and transported through the system. Of perhaps greater concern with the use of commercial ethanol in gasoline blends are phase separation problems which occur because water containing ethanol has limited solubility in gasoline. When phase separation occurs, corrosion of many of the metals and alloys which make up the vehicle fuel distribution system and the vehicle engine is promoted due to water contacting the metals and metal alloys. Specifically, fuel tank terne plate (steel coated with an alloy of lead 80–90% and tin 10–20%), zinc and aluminum die-cast carburetor and fuel pump parts, brass fittings, steel lines, etc. can corrode when exposed to gasoline-ethanol fuel mixtures. This problem can be remedied to some extent by the use of anhydrous or substantially anhydrous ethanol as a blending agent. However, if the fuel mixture is stored for too long a period of time before use, the anhydrous ethanol will pick up water from the environment and become hydrous or ("wet") ethanol and phase separation will occur. Even in the absence of phase separation, corrosion can be brought about by the presence of trace amounts of acetic acid, acetaldehyde, acetate and n-butanol in the ethanol-gasoline blends which are formed during the production of the ethanol. Other corrosion problems can arise from dissolved mineral salts, such as highly corrosive sodium chloride, which may be picked up by the fuel during production, storage and transportation.

Thus, there is presently a need for a corrosion inhibitor that will either curb or prevent the corrosion of conventional systems which are used to store and transport commercial ethanol in gasoline fuel blends and one that will curb or prevent corrosion of the vehicle fuel systems in which these fuels are ultimately used. Further, it is important that the corrosion inhibitor be effective in very small quantities to avoid any adverse effects, such as adding to the gum component of the fuel, etc., as well as to minimize cost. The corrosion inhibitors of the present invention satisfy these needs.

U.S. Pat. No. 2,334,158 discloses an anti-corrosive composition of matter comprising predominately non-gaseous hydrocarbons containing small amounts each of a polycarboxylic acid having at least 16 carbon atoms and a mutual solvent for hydrocarbons and water such as di-ethylene glycol mono alkyl ether or an ethylene glycol mono alkyl ether.

U.S. Pat. No. 2,962,443 discloses steam turbine lubricants containing the reaction product of:

(a) an aliphatic hydrocarbon-substituted succinic acid having the structure $$\begin{array}{l} R-CHCOOH \\ \quad\;\; | \\ \quad\;\; CH_2COOH \end{array}$$

in which R is an aliphatic hydrocarbon radical having at least 10 carbon atoms, with (b) from about 1 to about 75 percent on a molar basis of an alkylene oxide.

Reportedly, the addition of such a product to a steam turbine lubricant comprising a major amount of a mineral oil renders the lubricant resistant to rust and to the formation of stable emulsions.

U.S. Pat. No. 2,993,772 discloses a process for preventing, inhibiting and modifying the formation of deposits in internal combustion and jet engines employing a substantially hydrocarbon fuel which comprises burning in such engines a fuel consisting of a liquid hydrocarbon having a boiling point up to about 500° F. and a minor amount, in the range of approximately 0.001 to 2% by weight of the fuel, sufficient to prevent, inhibit and modify such deposits, of a member selected from the group consisting of an oil soluble alkenyl succinic acid and the anhydride thereof, having 8 to 31 carbon atoms on the alkenyl group.

U.S. Pat. No. 2,993,773 discloses a process for preventing, inhibiting and modifying the formation of deposits in internal combustion and jet engines employing a substantially hydrocarbon fuel which comprises burning in such engines a fuel consisting of a liquid hydrocarbon having a boiling point up to about 500° F. and a minor amount, in the range of approximately 0.001 to 2.0 weight percent of said fuel sufficient to prevent, inhibit and modify such deposits, of an ester of (1) a member selected from the group consisting of an alkenyl succinic acid and the anhydride thereof, having 8 to 31 carbon atoms on the alkenyl group and (2) an alcohol, said ester being soluble in said liquid hydrocarbon and being composed of only carbon, hydrogen and oxygen.

U.S. Pat. No. 3,117,091 discloses as rust preventative compounds for a petroleum based carrier such as motor gasoline, aviation gasoline, jet fuel, turbine oils and the like, the partial esters of an alkyl or alkenyl succinic anhydride produced by the reaction of one molar equivalent of a polyhydric alcohol with two molar equivalents of the anhydride.

U.S. Pat. No. 3,287,268 discloses the addition to sulfurized and/or chlorinated cutting oils an alkenyl succinic acid ester derivative to reduce the tendency of the oil to produce foam and to lessen the stability of the foam that is produced. The alkenyl succinic acid ester derivative employed comprises a mixture of an alkenyl succinic acid and an ester formed from that acid, or from a related alkenyl succinic acid containing about 8 to 30 carbon atoms in the alkenyl group, and a glycol of 2 to 4 carbon atoms.

U.S. Pat. No. 3,346,354 discloses a hydrocarbon fuel composition capable of reducing intake valve and port deposits which comprises a major proportion of a distillate hydrocarbon mixture boiling substantially in the range of from 100° F. to 750° F. and from 50 to 1000 ppm of a succinic acid derivative selected from the group consisting of (A) an alkenyl succinic acid, (B) an alkenyl succinic anhydride, and (C) an alkenyl succinic ester in which the alkoxy group contains from 1 to 6 carbon atoms, wherein the alkenyl groups (A), (B), and (C) contain from 50 to 250 carbon atoms.

U.S. Pat. No. 3,574,574 discloses a motor fuel composition which promotes reduced intake valve and port deposits containing from 0.005 to 0.1 volume percent of a polyester of a polymerized carboxylic acid.

U.S. Pat. No. 3,632,510 discloses lubricating and fuel compositions comprising a major amount of a lubricating oil and a minor proportion of an ester derivative of a hydrocarbon-substituted succinic acid wherein the hydrocarbon substituent contains at least about fifty aliphatic carbon atoms, the substituent being further characterized by having no more than about 5% olefinic linkages therein based on the total number of carbon-to-carbon covalent linkages in the substituent. The esters include the acidic esters, diesters, mixed ester-metal salts, and mixtures of these wherein the ester moiety is derived from monohydric and polyhydric alcohols, phenols, naphthols, and the like.

U.S. Pat. No. 3,687,644 discloses a gasoline composition containing as anti-icing additives 0.00001% to 0.02% by weight of a mono- or polycarboxylic acid, or an anhydride, ester, amide, imide thereof; and 0.01% to 5% by weight of an alcohol, glycol or polyol. Optionally, an ester of an alkoxylated phenol-aldehyde resin is also present.

U.S. Pat. No. 4,148,605 discloses novel dicarboxylic ester-acids resulting from the condensation of an alkenylsuccinic anhydride with an aliphatic hydroxy acid having from 2 to about 18 carbon atoms and amine salts of said ester-acid as rust or corrosion inhibitors in organic compositions.

U.S. Pat. No. 4,175,927 discloses exhaust hydrocarbon emissions of an internal combustion engine being operating on gasoline containing a cyclopentadienyl manganese antiknock are reduced by the addition of a dimer or a trimer acid or mixture of a dimer and a trimer acid produced by the polymerization or condensation of an unsaturated aliphatic monocarboxylic acid having between 16 and 18 carbon atoms per molecule to the gasoline.

U.S. Pat. No. 4,177,768 discloses an anti-wear compression ignition fuel for use in diesel engines comprising (1) a monohydroxy alkanol having from 1 to 5 carbon atoms, (2) an ignition accelerator and (3) a wear inhibiting amount of a dimerized unsaturated fatty acid and an ester of a phosphorus acid.

U.S. Pat. No. 4,185,594 discloses an anti-wear compression ignition fuel for use in diesel engines comprising (1) a monohydroxy alkanol having from 1 to 5 carbon atoms, (2) an ignition accelerator and (3) a wear inhibiting amount of a dimerized unsaturated fatty acid.

U.S. Pat. No. 4,207,076 discloses crude ethyl-t-butyl ether used as a cosolvent for hydrous ethanol in gasoline fuel mixtures. The ether solubilizes grain alcohol in all proportions in low aromatic content gasolines.

U.S. Pat. No. 4,207,077 discloses pure methyl-t-butyl ether used as a cosolvent for hydrous ethanol in gasoline fuel mixtures. The ether solubilizes grain alcohol in all proportions in low aromatic content gasolines.

U.S. Pat. No. 4,214,876 discloses improved corrosion inhibitor compositions for hydrocarbon fuels consisting of mixtures of (a) about 75 to 95 weight percent of a polymerized unsaturated aliphatic monocarboxylic acid having about 16 to 18 carbons, and (b) about 5 to 25 weight percent of a monoalkenyl-succinic acid wherein the alkenyl group has 8 to 18 carbons. Also described are concentrates of the above compositions in hydrocarbon solvents, as well as fuels containing the compositions.

U.S. Pat. No. 4,227,889 discloses an anti-wear compression ignition fuel composition for use in diesel engines comprising (1) from about 70 percent by weight to about 98.45 percent by weight of a monohydroxy alkanol having from 1–5 carbon atoms, (2) from about 1 percent by weight to about 25 percent by weight of a fuel oil boiling above the gasoline boiling range, and (3) a wear inhibiting amount of a dimerized unsaturated fatty acid. Optionally, said fuel composition may also contain an ignition accelerator such as an organic nitrate.

U.S. Pat. No. 4,242,099 discloses an anti-wear compression ignition fuel for use in diesel engines comprising (1) a monohydroxy alkanol having from 1 to 5 carbon atoms, and (2) a wear inhibiting amount of a $C_{12}$ to $C_{30}$ hydrocarbyl succinic acid or anhydride, e.g. tetrapropenyl succinic acid. Optionally, said fuel composition may also contain an ignition accelerator such as an organic nitrate.

U.S. Pat. No. 4,248,182 discloses an anti-wear compression ignition fuel for use in diesel engines comprising (1) a monohydroxy alkanol having from 1 to 5 carbon atoms, and (2) a wear inhibiting amount of a $C_8$ to $C_{20}$ aliphatic monocarboxylic acid. Optionally, said fuel composition may also contain an ignition accelerator such as an organic nitrate.

SUMMARY OF THE INVENTION

This invention is a fuel comprising a major amount of gasoline, a minor amount of ethanol and a corrosion inhibiting amount of a hydrocarbyl succinic acid or anhydride having from about 8 to 30 carbon atoms.

In accordance with the present invention, from about 1.0 to 100 ppm of the hydrocarbyl succinic acid or anhydride is blended with a fuel consisting of about 70 to about 95 volume percent gasoline and from about 5 to about 30 volume percent ethanol.

The invention is generally applicable to hydrocarbon mixtures in the gasoline boiling range of about 80° F. to about 430° F. These mixtures are obtained by separating an appropriate boiling fraction from a hydrocarbon distillate obtained in the refining of crude oil.

Processwise, the invention resides in blending, using suitable mixing equipment, gasoline, ethanol and the hydrocarbyl succinic acid or anhydride in the above given proportions.

As shown below, the addition of the hydrocarbyl succinic acid or anhydride of the present invention to ethanol-gasoline fuel mixtures impart anti-corrosion properties to the fuel mixture.

DESCRIPTION OF THE PREFERRED EMBODIMENTS

Thus, a preferred embodiment of the present invention is a liquid fuel for use in spark ignited internal combustion engines comprising a major amount of hydrocarbons boiling in the gasoline boiling range, a minor amount of ethanol and a corrosion inhibiting amount of a hydrocarbyl succinic acid or anhydride having from about 8 to 30 carbon atoms.

Another embodiment of the present invention is a process for conferring anti-corrosion properties to ethanol in gasoline fuel mixtures which comprises adding to a fuel comprising a major amount of hydrocarbons boiling in the gasoline boiling range and a minor amount of ethanol and a corrosion inhibiting amount of a hydrocarbyl succinic acid or anhydride having from about 8 to 30 carbon atoms.

The contemplated class of chemical compounds hereinafter described and set forth as rust preventative compounds are hydrocarbyl succinic acids or anhydrides having from about 8 to 30 carbon atoms. The hydrocarbyl-substituted succinic acid or anhydride may be prepared by the reaction of an olefin with maleic acid or maleic anhydride. For example, an alpha-olefin, such as those obtained from cracking wax (cracked wax olefins), is reacted with maleic anhydride or maleic acid to form an alkenyl succinic acid or anhydride. This product may then be hydrogenated to form the alkyl succinic anhydride or acid. However, in most instances there will be little advantage, if any, in the alkyl over the alkenyl succinic acid or anhydride. The methods of reacting an olefin with maleic anhydride are well known in the art and do not require exemplification here. Illustrative of various alpha-olefins which may find use are 1-octene, 1-dodecene, 1-tridecene, 1-tetradecene, 1-pentadecene.

When the addition reaction with maleic anhydride is utilized, or otherwise, it is often desirable to use as the olefinic hydrocarbon reactant a low molecular weight polymer of a $C_2$ to $C_4$ olefin (i.e., an oligomer of $C_2$ to $C_4$ olefin). Such oligomers are represented by tetrapropylene, triisobutylene, tetraisobutylene, etc. Such oligomers are mono-olefins of a straight or branched chain structure.

In addition, the rust inhibiting compounds of the present invention can be prepared with the use of a petroleum diluent. The amount of diluent may vary, for example, from about 0 to 80 weight percent, preferably from about 30 to 50 weight percent.

A particularly preferred method in preparing the reaction product of this invention is the addition of the oligomer tetrapropylene to maleic acid anhydride or acid. The most preferred hydrocarbyl succinic acid component of this invention is tetrapropenyl succinic acid. In U.S. Pat. No. 2,334,158 there is disclosed the use of an alkylated succinic acid containing at least 16 carbon atoms in gasoline as a rust inhibitor. In U.S. Pat. No. 3,447,918 there is disclosed the use of a polybutene substituted succinic acid as a rust inhibitor in distillate fuel.

The hydrocarbon fuel component of the ethanol-hydrocarbon fuel mixtures into which the rust inhibiting additives of this invention are incorporated to provide corrosion inhibiting characteristics to the fuel mixtures are liquid hydrocarbon fuels boiling in the range of about 80° F. to about 430° F. and include motor gasolines, aviation gasolines, jet fuels, kerosenes, diesel fuels and fuel oils. The ethanol-hydrocarbon fuel compositions containing the rust inhibiting compounds of this invention may also contain conventional additives such as antiknock compounds, antioxidants, metal deactivators, antistatic agents, anti-icing agents, detergents, dispersants, thermal stabilizers, dyes and the like.

The ethanol blending agent component of the present fuel mixtures can be either anhydrous or hydrous ethanol. That is, either 200 proof ethanol or hydrous (or "wet") ethanol containing up to about 5 volume percent water can be blended with the hydrocarbon and anti-corrosion compound components of the fuel mixtures of this invention. The amount of ethanol which can be present in the fuel mixture of the present invention can range from about 5 to about 30 percent by volume.

While the foregoing disclosure has thus far illustrated the invention mainly by reference to the use of ethanol as the alcohol blending agent or component of the fuel mixture, it is to be understood that ethanol can be replaced in the present fuel mixtures with other suitable alcohol blending agents such as methanol, propanol, n-butanol, isobutanol and t-butyl alcohol in approximately the same amounts by volume as ethanol.

As set forth above, from about 1.0 to about 100 ppm, and preferably from about 5 to 50 ppm, of the corrosion inhibiting hydrocarbyl succinic acid or anhydride additives of the present invention are blended with the ethanol containing hydrocarbon fuel mixtures.

The corrosion inhibiting compounds of the present invention can be added to the ethanol containing gasoline fuel mixtures disclosed herein by any means known in the art for incorporating small quantities of additives into conventional hydrocarbon fuels. In general, effective amounts of the corrosion inhibiting compounds are simply added to and blended with the ethanol-containing hydrocarbon fuels.

Obviously, many modifications and variations of the invention hereinbefore set forth may be made without departing from the spirit and scope thereof and therefore only such limitations should be imposed thereon as are indicated in the appended claims.

The following examples illustrate the invention.

EXAMPLE I

Anti-Corrosion Evaluation Tests

Various fuel blends were compared for anti-rust performance using a rust inhibiting composition of this invention. Test fuels were prepared using a Brazilian type fuel simulated from a U.S. unleaded gasoline, hydrous (or "wet") ethanol and a anti-corrosion composition of the invention. Comparisons were made between gasoline-ethanol blends containing no corrosion inhibitor and gasoline-ethanol blends containing different amounts of a corrosion inhibiting composition representative of those disclosed herein comprising 1.0 PTB (lb/1000 bbl) of tetrapropenyl succinic acid obtained commercially from the Milliken Chemical Division of Milliken Co., P.O. Box 817, Inmar, S.C., 29349. The gasoline portion of these fuel blends had the following specification:

| ASTM D-86 Distillation | °F. |
|---|---|
| Initial Boiling Point | 86 |
| 5% | 109 |

-continued

| | |
|---|---|
| 10% | 128 |
| 15% | 143 |
| 20% | 158 |
| 30% | 185 |
| 40% | 208 |
| 50% | 223 |
| 60% | 235 |
| 70% | 248 |
| 80% | 271 |
| 85% | 290 |
| 90% | 315 |
| 95% | 342 |
| Final | 399 |
| Recovery | 97.3 ml. |
| Residue | 0.3 ml. |
| Loss | 2.4 ml. |
| ASTM D-323 Reed Vapor Pressure (lbs.) | 9.02 |
| ASTM D-525 Oxidation Stabilization | 1440 + min. |
| Lead Content | 0.003 g/gal |
| Mn Content | 0.001 g/gal |
| Gravity (D-287) °API | 60.3 |
| ASTM D-1319 Hydrocarbon Types | |
| Saturates Vol. % | 71.5 |
| Olefins Vol. % | 2.5 |
| Aromatics Vol. % | 26.0 |

The test fuels were prepared by blending several samples of 20 volume percent anhydrous ethanol with 80 volume percent of the aforedescribed gasoline. The aforedescribed anti-corrosion composition was then added to these blends. After the test fuels were blended, they were added to individual 8.0 oz. glass screw-capped bottles in 100 ml. amounts. The fuels were then contacted with approximately 1.5 volume percent distilled water sufficient to cause phase separation. Control fuels were prepared by blending samples of 20 volume percent anhydrous ethanol with 80 volume percent of the previously described gasoline. Like the test fuels, the control fuels were placed in 8.0 oz. glass screw-capped bottles in 100 ml. amounts and then contacted with approximately 1.5 volume percent distilled water to cause phase separation. In all of the fuels tested, both control and test fuels, 37.5 ppm acetic acid, 75.0 ppm acetaldehyde, 100 ppm ethylacetate and 75.0 ppm n-butanol were added to the fuels to simulate in-service production Brazilian fuel.

Weighed metal coupons (approximately $\frac{3}{4}''\times 4''\times 1/32''-\frac{1}{8}''$) representative of those metals common to vehicle distribution systems and vehicle engines were inserted into the glass bottles containing the test fuels. The following metals, identified by Unified Designation No., as reported in the *Unified Numbering System for Metals and Alloys,* 2nd Ed. Warrendale, Pa., Society of Automotive Engineers, 1977, were selected for anti-rust evaluation:

1. Steel, mild carbon, (Unified Designation G10200). Used in tanks and vehicle fuel lines.
2. Zinc casting alloy, (Unified Designation Z35531). Used in carburetors and fuel pumps.
3. Ninety percent lead-10% tin alloy used widely on terne plate, (Unified Designation L05100). Used in vehicle fuel tanks.

The bottles and contents were then stored at 43° C. for a pre-determined time (14 days). At the end of this time, the coupons were removed from the bottles and their condition observed and recorded. The coupons were then cleaned of corrosion product by established, non-corroding chemical procedures (boiling 20% sodium hydroxide and zinc dust for steel; saturated ammonium acetate solution at room temperature for zinc alloy; and hot concentrated ammonium acetate solution for lead-tin metal alloy). The cleaned coupon was then washed with distilled water, dried and weighed. The weight loss was taken as a measure of corrosion. The results of these tests are set forth in the following table:

TABLE I

14 Day Corrosion Inhibiting Tests

| Inhibitor Composition | Weight Loss, mg. | % Reduction in Weight Loss |
|---|---|---|
| | STEEL | |
| Control Fuel (No Inhibitor) | 21.6 | |
| Control Fuel + 1.0 PTB Tetrapropenyl Succinic Acid | 5.9 | 73 |
| | ZINC ALLOY | |
| Control Fuel (No Inhibitor) | 109.3 | |
| Control Fuel + 1.0 PTB Tetrapropenyl Succinic Acid | 75.8 | 31 |
| | LEAD-TIN ALLOY | |
| Control Fuel (No Inhibitor) | 18.8 | |
| Control Fuel + PTB Tetrapropenyl Succinic Acid | 17.9 | 5 |

The results summarized in Table I demonstrate that the anti-rust compositions of the present invention are effective corrosion inhibitors in the ethanol-gasoline fuel mixtures at very low concentrations. The results show that those metals and metal alloys exposed to fuels containing a corrosion inhibitor composition of the present invention exhibited a significant reduction in weight loss when compared to like metals and metal alloys exposed to the same fuel blends containing no corrosion inhibitor.

I claim:

1. A liquid fuel for use in internal combustion engines comprising a major amount of hydrocarbons boiling in the gasoline boiling range, a minor amount of ethanol, and a corrosion inhibiting amount of tetrapropenylsuccinic acid or anhydride.

2. The fuel of claim 1 wherein said ethanol is anhydrous or substantially anhydrous ethanol.

3. The fuel of claim 1 wherein said ethanol is hydrous ethanol.

4. The fuel of claim 3 wherein said ethanol contains up to about 5.0 volume percent water.

5. The fuel of claim 1 which comprises blending from about 70 to about 95 volume percent gasoline, from about 5 to about 30 volume percent hydrous ethanol and from about 1.0 to about 100 ppm of tetrapropenylsuccinic acid or anhydride.

* * * * *

UNITED STATES PATENT AND TRADEMARK OFFICE

CERTIFICATE OF CORRECTION

PATENT NO. : 4,440,545

DATED : April 3, 1984

INVENTOR(S) : Charles F. Weidig

It is certified that error appears in the above-identified patent and that said Letters Patent is hereby corrected as shown below:

On the face page, U.S. Patent Documents notes 3,287,268 with an inventor name of "Bayonne", should read --Tico--.

Column 8, line 30, reads "Control Fuel + PTB", should read --Control Fuel + 1.0 PTB--.

Signed and Sealed this

*Thirteenth* Day of *November 1984*

[SEAL]

*Attest:*

GERALD J. MOSSINGHOFF

*Attesting Officer*

*Commissioner of Patents and Trademarks*